United States Patent [19]

Waters

[11] Patent Number: 4,939,803

[45] Date of Patent: Jul. 10, 1990

[54] STRETCHER COVER

[76] Inventor: Phillip N. Waters, 102 Flint Ridge Apts., Bldg. 5, Hillsborough, N.C. 27278

[21] Appl. No.: 401,028

[22] Filed: Aug. 31, 1989

[51] Int. Cl.[5] ..... A47C 29/00

[52] U.S. Cl. ..... 5/414; 5/82 R; 5/113

[58] Field of Search ..... 5/82 R, 97, 113, 114, 5/121, 284, 414

[56] References Cited

U.S. PATENT DOCUMENTS

| | | | |
|---|---|---|---|
| D. 235,585 | 6/1975 | Stevens | D88/3 B |
| D. 298,768 | 11/1988 | Dwosh | D21/253 |
| 1,254,529 | 1/1918 | Panganiban . | |
| 1,702,010 | 2/1929 | Klever . | |
| 2,508,254 | 5/1950 | Ham | 5/113 X |
| 2,654,897 | 10/1953 | Knopf | 5/86 |
| 2,771,087 | 11/1956 | Simonson | 135/4 |
| 3,121,881 | 2/1964 | Schnell | 5/414 X |
| 3,601,825 | 8/1971 | Moorehead | 5/113 |
| 3,646,860 | 3/1987 | Owens | 180/19.2 |
| 3,710,791 | 1/1973 | Deaton | 128/191 A |
| 3,751,741 | 8/1973 | Hendry . | |
| 3,798,685 | 3/1974 | Hunt et al. | 5/82 X |
| 3,848,279 | 11/1974 | Ipsen, Jr. | 5/113 |
| 3,896,832 | 7/1975 | Montoya | 135/6 |
| 4,124,908 | 11/1978 | Burns et al. | 5/82 R |
| 4,224,936 | 9/1980 | Cox | 5/82 R X |
| 4,232,692 | 11/1980 | Atkins | 135/5.1 |
| 4,275,719 | 6/1981 | Mayer | 128/132 |
| 4,389,066 | 6/1983 | Weir | 296/19 |
| 4,465,066 | 8/1984 | Carpel | 128/132 D |
| 4,686,720 | 8/1987 | Newell | 5/121 |
| 4,739,753 | 4/1988 | Brehm | 128/200.24 |
| 4,766,918 | 8/1988 | Odekirk | 135/96 |

*Primary Examiner*—Michael F. Trettel

*Attorney, Agent, or Firm*—Olive & Olive

[57] ABSTRACT

A stretcher cover of the invention extending over the top of the stretcher, being elevated at the head end which has a pocket for insertion of one end of the stretcher, and being gathered about the foot end of the stretcher. A flexible U-shaped support structure keeps the head end of the cover elevated. Openings covered by flaps at the side and head of the cover enable access to a patient on the stretcher.

8 Claims, 3 Drawing Sheets

STRETCHER COVER

BACKGROUND OF THE INVENTION

1. Field of the Invention

This invention relates to structures or cots used for rescue and ambulance service and in hospitals. In particular, this invention pertains to a stretcher cover that covers and protects the patient and provides a barrier between the patient and medical personnel but allows medical access to the patient.

2. Description of the Related Art

Stretchers and other types of portable cot structures are used in disaster and emergency situations to enable injured people to be removed with the minimum of jostling or sudden movement that might increase or aggravate the person's injuries. Many such emergencies occur in or are caused by environments having toxic chemicals, flying debris, fumes, smoke, or other airborne materials that may cause further injury to the patient, aggravate the current injury, and/or make it difficult for the person to breathe.

It is difficult to protect the injured person from airborne materials without either risking suffocation or overheating of the person, or without having a very bulky suit or large enclosure covering the person. In cases of severe injury, it is not generally possible or desirable to place the injured person in a restrictive protective suit that closely covers the patient or requires that the patient be moved to put him in the suit or enclosure.

In many environments where stretchers need to be used, it is also not possible to carry in large enclosures or other devices, or such devices may not be sufficiently portable to enable the patient to be removed quickly from the danger area.

Emergency medical treatment is also often needed for patients whose bodily fluids contain infectious bacteria or viruses, for example HIV, or who may be otherwise capable of disseminating contagious microorganisms. Paramedics run significant risks when they carry such patients on an open stretcher because of their close proximity to the patient for an extended period of time, unless there is some type of prophylactic barrier between the patient and the paramedic.

Patients being carried on stretchers, such as those who are in critical condition, often have cardiac monitors or various other pieces of portable monitoring or treatment equipment on the stretcher with them that may be sensitive to moisture or exposure to other environmental substances. Use of stretchers without covers being placed over this equipment often subjects the equipment to harmful environments, including inclement weather.

Thus, there is a need for a stretcher cover that is light-weight and easily portable and protects the injured person from dangerous environmental hazards such as exposure to airborne materials, but enables access of medical personnel to the patient.

It is therefore an object of this invention to provide a stretcher cover that completely covers and protects the patient but allows medical access to the patient.

It is a further object of the invention to provide a stretcher cover that is easily removable from the stretcher and easily attachable to the stretcher.

It is another object of the invention to provide a stretcher cover that is elevated at one end and easily portable.

It is another object of the invention to provide a stretcher cover that is light-weight.

It is another object of the invention to provide a stretcher cover that serves as a prophylactic barrier between a patient and medical personnel.

It is a further object of the invention to provide a stretcher cover that serves to protect sensitive medical equipment being carried on the stretcher.

Other objects and advantages of the invention will be more fully apparent from the following disclosure and appended claims.

SUMMARY OF THE INVENTION

The stretcher cover of the invention extends over the top of the stretcher, being elevated at a head end which has a pocket for insertion of one end of the stretcher, and being gathered about the foot end of the stretcher. A flexible U-shaped support structure keeps the head end of the cover elevated. Openings covered by flaps at the side and head end of the cover enable access to a patient on the stretcher.

Other aspects and features of the invention will be more fully apparent from the following disclosure and appended claims.

DETAILED DESCRIPTION OF THE INVENTION AND PREFERRED EMBODIMENTS THEREOF

Figure 1:
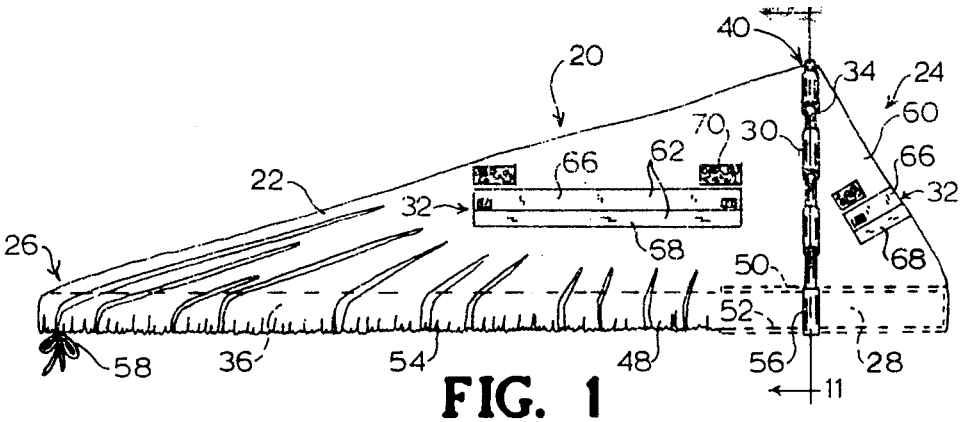
FIG. 1 is a side perspective view of the stretcher cover of the invention.

The present invention consists of a stretcher cover comprising:

(a) a flexible cover 22 piece having an enlarged first end 24 and a second end 26 smaller than the first end 24, said cover piece 22 comprising:

(i) a stretcher insertion pocket 28 at said first end 24;

(ii) a plurality of support structure holders 30 extending across said first end 24;

(iii) a means for securely holding the second end to a stretcher; and (iv) a plurality of flap-covered openings 32 on said cover piece 22; and (b) a flexible support structure 34 insertable in said support structure holders 32.

Preferably, the first end 24 is at the head end of the stretcher cot 36 and the second end 26 is at the foot end of the stretcher cot 36.

Figure 12:
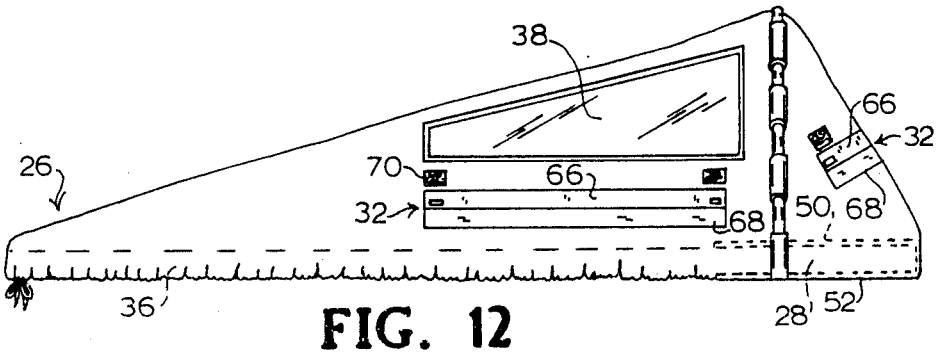
FIG. 12 is a perspective view of the stretcher cover of the invention showing an optional view panel.

The flexible cover piece 22 is formed of such materials as fabrics, plastics, coated fabrics or other flexible materials. The materials are preferably at least translucent and may be transparent to allow viewing of the patient. Alternatively, the cover piece 22 may have one or more transparent panels 38 located at appropriate viewpoints on the cover (FIG. 12). The materials of construction of both the cover piece 22 and of the panels 38 are preferably materials that are fire proof, heat resistant, moisture proof and repellant of chemicals or have been treated by known methods to have these characteristics.

The cover piece 22 is formed by cutting a piece of the appropriate fabric or other material in a manner such as is used in the making of tents that are tapered in height from one end to the other as shown in a side view of the invention (FIG. 1). The stretcher cover 22 is long enough to extend around all edges of the stretcher or cot 36, and to have a domed area 40 that is about 1–2 feet from the head end (first end 24) of the stretcher 36 and is about 2 feet high.

Figure 2:
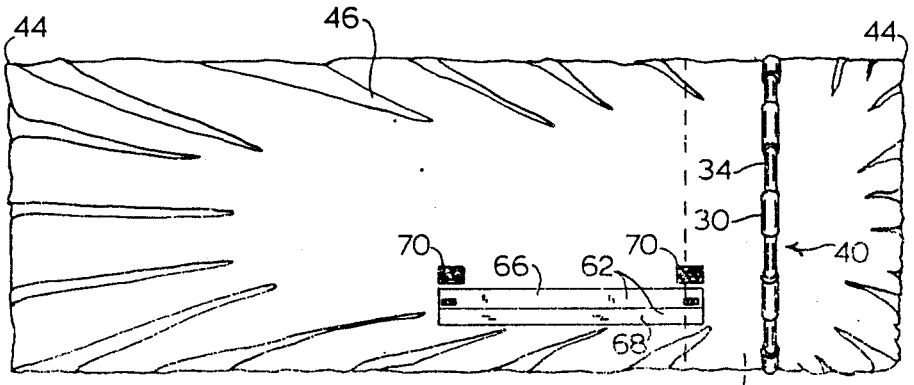
FIG. 2 is a top perspective view of the stretcher cover of the invention.
Figure 3:
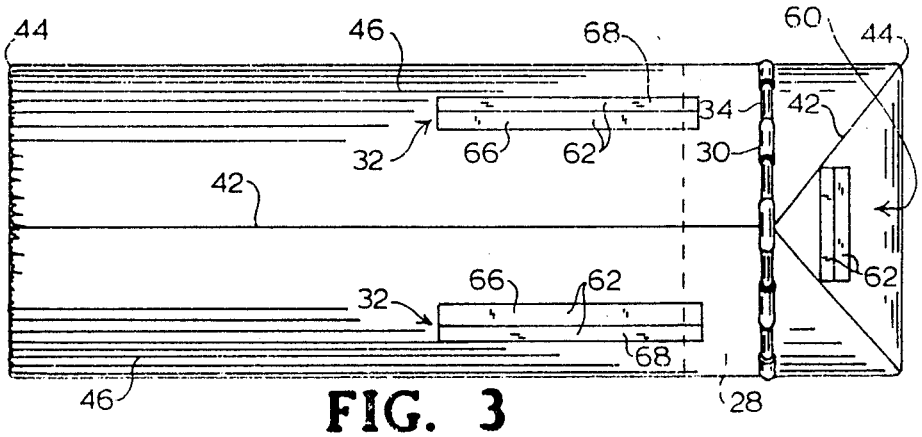
FIG. 3 is a top perspective view of an embodiment of the stretcher cover of the invention having seams.
Figure 4:
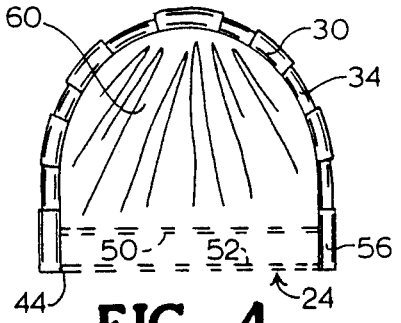
FIG. 4 is a perspective view of the head end of the stretcher cover of the invention.
Figure 5:
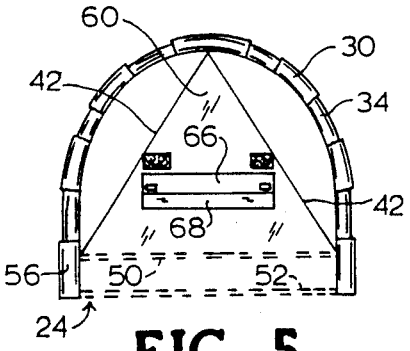
FIG. 5 is a perspective view of the head end of a second embodiment of the stretcher cover having seams.
Figure 7:
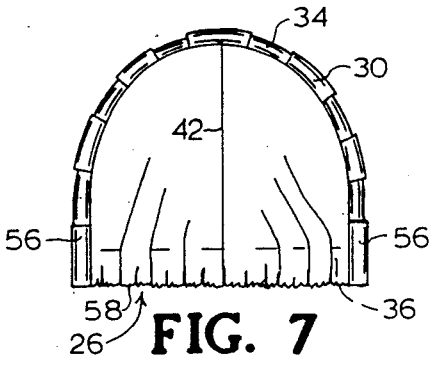
FIG. 7 is a perspective view of the foot end of a second embodiment of the stretcher cover of the invention with seams.

The material may be cut in a tapered manner to allow for additional material at the domed head end 24, or may be gathered, pleated or otherwise drawn into a small area as it extends from the head end 24 to the support structure 34 to the foot end 26 (FIG. 2). As shown in FIGS. 3, 5, and 7, the stretcher cover 22 may have seams 42 as are known in the art of sewing or of manufacture of flexible plastic items, so that the cover 22 more smoothly fits over the support structure 34 and around the cot corners 44.

The material along the sides 46 of the cover preferably extends down to the bottom 48 of the sides of the cot 36 and may extend for a short distance along the bottom of the cot. The material at the edges of the cover may be elastic-gathered or otherwise tightened to hold the edge down, or may have fastening means (for example, velcro, buttons, straps across the bottom of the cot, etc.) to hold the cover sides to the sides and/or bottom of the stretcher cot.

A pocket area 28 is formed into the larger ("head") end (first end 24) of the cover piece 22 so that the head end of the cot may be inserted into the cover (FIG. 1). This pocket area 28 may be formed by sewing or otherwise attaching a first horizontal piece 50 of material at the head end of the cover to extend below the cot and a second horizontal piece 52 of material parallel to and spaced above the first piece an appropriate distance (at least equal to the height of the cot) to allow the head end of the cot to be inserted into the pocket area 28. Preferably, the pocket 28 is the width and height of the stretcher or cot 36 to be used and is about 1–2 or more feet deep to enable the stretcher to remain securely held in the stretcher cover at the head end. If the pocket is too deep (e.g., half the length of the cot or more, it is increasingly difficult to insert or remove the cot from the cover. The stretcher cover 22 preferably fully encloses the head end of the cot by extending downward from the support structure, over the sides of the cot at the head end and between the first and second horizontal pieces 50, 52 that form the pocket.

About 1–2 feet from the head end, a series of support structure holder(s) 30 extend upward from one side across the head end 24 perpendicular to the longitudinal axis of the stretcher 36 and cover 22 and downward on the other side (FIG. 1). The particular location of the support structures holders 30 should be on the stretcher cover 22 that extends above the area of the cot where the patient's head is likely to rest.

The support structure holders 30 may be loops of fabric or other flexible material, such as are used in holding tent rods to tents, and preferably extend along a track from the stretcher cover bottom, across and above the patient, and back down the other side of the stretcher cover 22. Alternatively, the holder(s) may comprise an unbroken tube of fabric or other flexible material attached to the cover and extending from one side of the cover, over the patient head area, and down the other side, or a series of loops attached along the same track area. An end support structure holder 56 is placed at each side of the stretcher cover 22 in line with the above-mentioned series of holders 30. Preferably each end support structure holder 56 is closed at the bottom to keep the support structure 34 from slipping out of the series of holders 30. The support structure holders 30 are preferably located along the exterior surface of the stretcher cover for ease of insertion of the support structure.

The flexible support structure 34 is preferably constructed in a manner similar to that used for rods used to support modern light-weight tents. Thus, preferable materials include hollow aluminum or fiberglass rods. Multiple-sectioned rods linked together by interior rope mechanisms as are used in some modern light-weight tents may be used in the invention. This allows the support structure to be stored in a relatively small area when not in use in the stretcher cover 22, by placing the multiple rod sections parallel to and adjacent to each other. Alternatively, a one-piece flexible rod piece such as bendable, but sturdy rubber or plastic type materials may be used. The length of the support structure 34 (and the length of the track of the support structure holders) is sufficient so that the uppermost point on the assembled stretcher cover is about two feet high.

Figure 6:
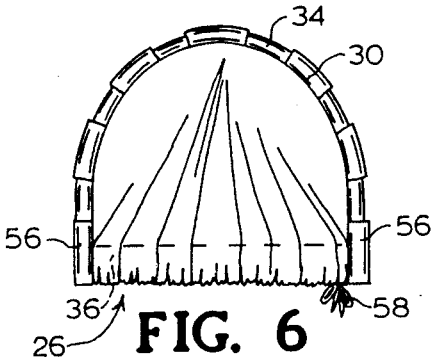
FIG. 6 is a perspective view of the foot end of the stretcher cover of the invention.

At the foot end (second end 26) of the cover 22, the cover 22 may be gathered with elastic and/or drawstrings 58 so that it may slipped easily over the foot of the stretcher (FIGS. 1, 6, and 7).

Preferably the two sides 46 of the stretcher cover and the side 60 of the cover at the head end each have flap-covered openings 32 to enable medical personnel to have access to a patient on the stretcher. The flaps 62 may be constructed of the same material as the cover or of other durable flexible material.

The means of construction of the flap or flaps 62 may be any means known for constructing flaps in fabric such as are used on tents or for flaps covering pocket openings. Preferably, the flaps allow easy access to the patient by being openable.

In a simple embodiment of the invention, each flap comprises a slit in the wall of the cover that is covered by a flap hanging over the slit. The flapped pieces 62 may be held back completely or partially away from the opening 32, such as by a plurality of appropriately positioned Velcro TM pieces 64 or ties or other means, while medical personnel are providing medical attention to the patient or to increase ventilation of the enclosed area inside the cover when it is not located in toxic or dangerous environments and exposure of medical personnel to patient contamination is not a problem. When the opening 32 is not in use it is preferably closable in a manner that does not allow easy entry of airborne materials. Such closure may be by means of a weighted cover flap hanging over the slit opening or by a cover flap held by Velcro TM and/or a zipper means, or other closure means.

Figure 8:
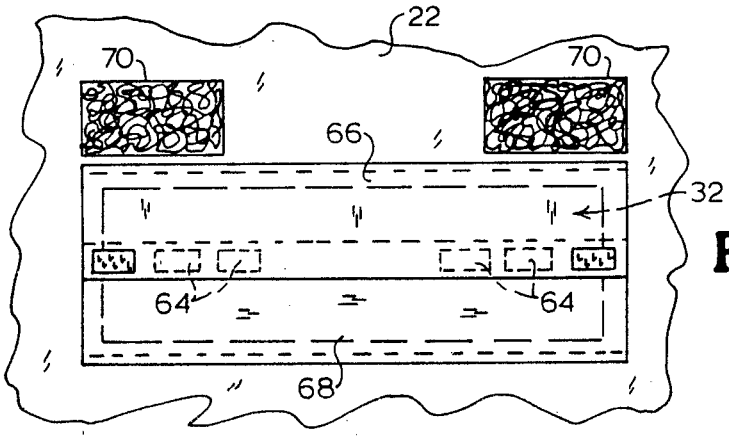
FIG. 8 is a perspective view of a flap on the stretcher cover of the invention.
Figure 9:
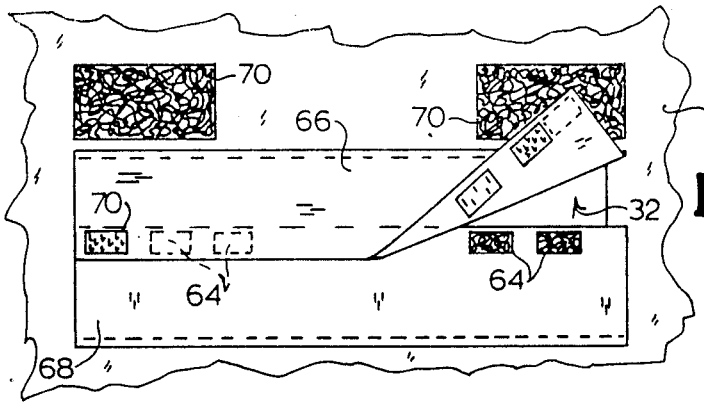
FIG. 9 is a perspective view of a partially open flap on the stretcher cover of the invention.
Figure 10:
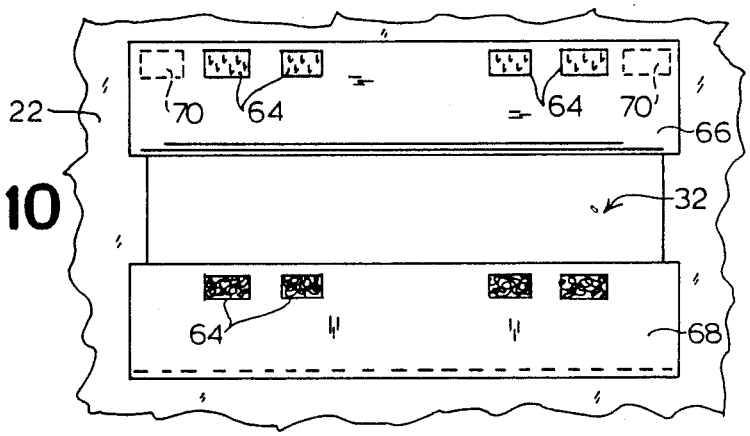
FIG. 10 is a perspective view of an open flap on the stretcher cover of the invention.
Figure 11:
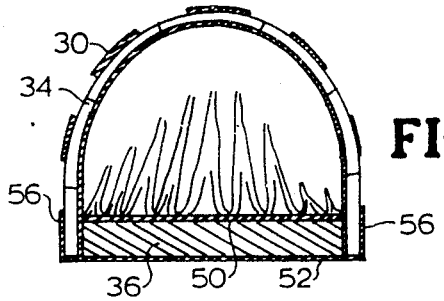
FIG. 11 is a cross-sectional view at the support structure of the stretcher cover on a stretcher.

A preferred embodiment of a flap 62 of the invention is shown in FIGS. 8–10. It comprises an upper portion 66 and a lower portion 68 that are each sewn to the stretcher cover at the top and bottom edges of a hole in the cover. The two portions of the flap 62 may be releasably held together and to the sides of the hole by any type of fastening means, such as by Velcro TM, snaps or other means 64 when the hole is to be closed (FIG. 8). Extra fastening means 70 are attached to the outside of the cover around the opening 32 so that each flap may be opened in a variety of partial positions (see for example, FIG. 9), or may be completely opened (FIG. 10). Although not shown in the Figures, both flaps may be openable or only one flap may be openable as shown. The flaps may open horizontally as shown in the Figures, or may open vertically as may be useful for particular purposes.

Preferably the side flaps 62 are about two feet long and about six inches wide (high) but they may extend for about three feet or more for easier patient access. The front flap, if present, may be shorter and extend across for about the width of a person's head (approximately a foot long). The front flap enables medical maintenance of tubing, oxygen supply mechanisms or other equipment attached to the patient's head.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A stretcher cover, comprising:

(a) a flexible cover piece having an enlarged first end and a second end smaller than said first end, said cover piece having:

(i) a stretcher insertion pocket at said first end comprising two spaced parallel layers of material;

(ii) a plurality of support structure holders extending across said first end;

(iii) a means for securely holding the second end to a stretcher; and (iv) a plurality of flap-covered opening areas on said cover piece; and (b) a flexible support structure insertable in said support structure holders.

2. A stretcher cover according to claim 1, wherein the support structure holders are loops of durable flexible material an the flexible support structure comprises a plurality of hollow linked rods.

3. A stretcher cover according to claim 1, wherein flap-covered openings are positioned on each side of the cover and at the first end.

4. A stretcher cover according to claim 2, wherein a portion of the cover is transparent.

5. A stretcher cover according to claim 4, wherein the portion comprises a transparent panel.

6. A stretcher cover according to claim 1, wherein the means for securely holding the second end to a stretcher comprises gathering the second end.

7. A stretcher cover according to claim 1, wherein the flap-covered openings may be opened either partially or completely.

8. A stretcher cover comprising:

(a) a flexible cover piece having an enlarged first end and a second end smaller than said first end, said cover piece having:

(i) a stretcher insertion pocket at said first end, said stretcher insertion pocket comprising two horizontally extending pieces of material;

(ii) a plurality of support structure holders extending across said first end;

(iii) a means for securely holding the second end to a stretcher; and (iv) a plurality of flap-covered opening areas on said cover piece; and (b) a flexible support structure insertable in said support structure holders.

* * * * *